United States Patent [19]

Higashi

[11] 4,173,851

[45] Nov. 13, 1979

[54] BARREL POLISHING PROCESS

[76] Inventor: Yasunaga Higashi, 171-1, Kotsuki-cho, Kashihara-shi Nara-ken, Japan

[21] Appl. No.: 870,928

[22] Filed: Jan. 18, 1978

[30] Foreign Application Priority Data

Jan. 29, 1977 [JP] Japan ..... 52-8904

[51] Int. Cl.[2] ..... B24B 1/00; B24B 31/02

[52] U.S. Cl. ..... 51/317; 51/7

[58] Field of Search ..... 51/6, 7, 19, 317

[56] References Cited

U.S. PATENT DOCUMENTS

| | | | |
|---|---|---|---|
| 2,218,353 | 10/1940 | Gruenberg | 51/7 |
| 2,664,676 | 1/1954 | Cuppers | 51/7 |
| 2,749,669 | 6/1956 | Sleeper | 51/19 X |
| 2,899,777 | 8/1959 | Davidson | 51/7 |
| 3,623,278 | 11/1971 | Schwartz | 51/7 X |
| 4,034,515 | 7/1977 | Ohno | 51/7 |

*Primary Examiner*—Gary L. Smith

*Attorney, Agent, or Firm*—Wenderoth, Lind & Ponack

[57] ABSTRACT

An improved barrel polishing process is disclosed in which pieces or parts mounted in a rotary barrel on spindles carried by the head thereof are passed through the abrasive layer formed in the barrel. The pieces are forced to turn around a vertical shaft while turning on their own axis so that they pass alternately through a denser portion of the abrasive layer and through a coarser portion. This ensures a uniform finishing of the pieces.

1 Claim, 2 Drawing Figures

BARREL POLISHING PROCESS

The present invention relates to an improved barrel polishing process.

Various types of barrel polishing or finishing processes are known in which a closed barrel containing a mass of abrasive and the pieces to be finished is rotated at a high speed to form an annular layer of abrasive on the inner periphery of the barrel by the action of centrifugal force and the pieces are brought into forced contact with the abrasive mass. Such conventional process has a disadvantage that since the abrasive layer has a density which is uniform in a vertical direction but not uniform in a radial direction, some pieces are forced to pass only through a denser area, while other ones are forced to pass only through a coarser area. This results in uneven polishing.

An object of this invention is to provide an improved barrel polishing process which obviates such a shortcoming and ensures uniform polishing.

Figure 1:
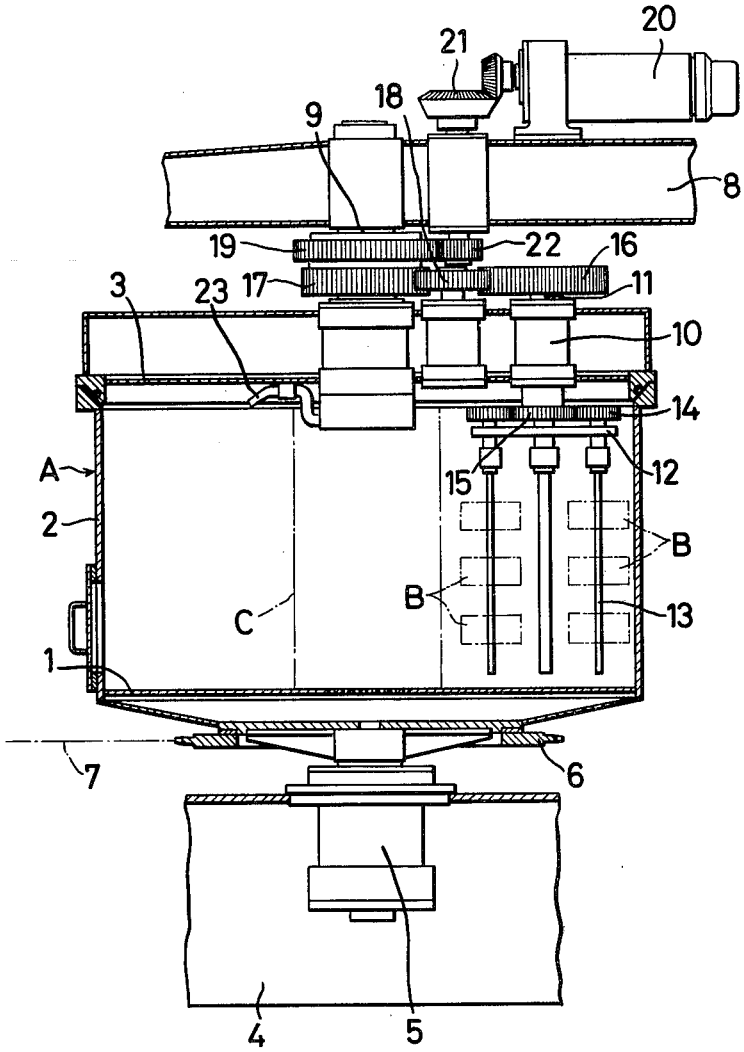
Figure 2:
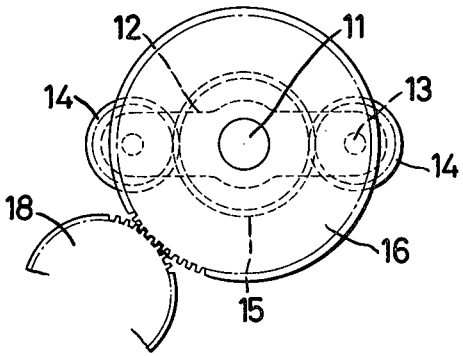

Other features and advantages of this invention will become apparent from the following description taken with reference to the accompanying drawings, in which:

FIG. 1 is a partially sectional front view of a polising apparatus for carrying out the process according to this invention; and FIG. 2 is an enlarged plan view of a portion of the polishing apparatus of FIG. 1.

Referring to the drawings, a barrel generally designated by A includes a bottom wall 1, a peripheral wall 2, and a head 3 providing a closure for the upper opening of the barrel.

The barrel A contains a mass of abrasive C and is driven by a motor (not shown) through a chain 7 passed around a motor sprocket (not shown) and a sprocket 6 which is secured to the bottom wall 1 and journaled on a bearing 5 supported in a frame 4.

The head 3 is mounted on the bottom end of a shaft 9, the shaft having its top end journaled in an arm 8. The head can be opened by raising the arm 8, for example by means of a hydraulic piston cylinder device.

A shaft 11 is rotatably mounted in a respective tubular member 10 supported in the cover 3 at each of a plurality of equally angularly spaced peripheral positions. For clarity, only a single tubular member and related parts are shown in FIG. 1. A plate 12 is fixedly mounted on the lower end of the shaft 11. At each end of the plate 12 is rotatably mounted a spindle 13 on which the pieces B to be polished are mounted. Each spindle 13 carries a planetary gear 14 fixed to the top end thereof and which is in meshing engagement with a stationary gear 15 fixedly mounted on the lower end of the tubular member 10.

A gear 16 is fixedly mounted on the top end of the shaft 11 in meshing engagement with an intermediate gear 18 which in turn meshes with a first gear 17. The first gear 17 is fixedly mounted on the shaft 9 below a second gear 19 which is fixedly mounted thereon in engagement with a third gear 22 coupled through a gear 21 with an electromagnetic brake 20 mounted on the arm 8. The brake serves to keep the second gear 19 and thus the first gear 17 stationary.

The barrel A is provided with a nozzle 23 for supplying water during a finishing operation and has a small hole in the bottom wall 1 to drain the water.

In operation, with the barrel A stopped the arm 8 is raised to remove the head 3. After the pieces B to be polished have been mounted on the spindle 13, the arm 8 is lowered to position the cover on the barrel A.

When the barrel is rotated at a high speed in one direction, the abrasive C forms an annular layer on the inner surface of the peripheral wall 2 due to centrifugal force. The layer will have a density which is uniform in a vertical direction but not uniform in a radial direction. Its density will be high in the outer peripheral portion and be low in the inner peripheral portion.

As the barrel rotates, the gear 16 turns around the first gear 17 which is kept stationary by the brake 20, through the intermediate gear 18. Simultaneously, the shaft 11 and thus the plate 12 turn. As the plate 12 rotates, the pieces B on the rod 13 rotate around the shaft 11 through the layer of abrasive C. They also rotate on their own axis since the planetary gears 14 mesh with the stationary gear 15. In other words, the pieces B turn around the shaft 11 while turning on their own axis.

This arrangement ensures that the pieces to be finished pass through the abrasive layer alternatively from a high-density region to a low-density region and vice versa. This assures uniform polishing. The density of the abrasive layer can be adjusted according to the pieces to be processed by changing the speed of rotation of the barrel. The position of the pieces relative to the peripheral wall 2 can also be varied by replacing the gears with ones of different size and/or gear ratio.

It will be understood from the foregoing that the barrel polishing process according to this invention provides for more uniform and more effective polishing than the conventional process.

Although a polishing barrel for carrying out the process according to this invention has been described, various changes or variations may be added without departing from the scope of this invention.

In order to perform a series of finishing steps efficiently, a few such polishing barrels may be arranged around a center post with their heads coupled with an arm extending from the center post so that a batch of pieces can be easily moved from a work setting station to a rough finishing station and then to a fine finishing station, for example. By raising the heads of all the barrels at one time by the arms which can be driven by a single hydraulic cylinder and turning the entire arm-head assembly by means of some suitable means, a batch of the pieces can be moved from one station to another without removing them from and remounting them on the spindles.

What is claimed is:

1. A process for abrading pieces to be finished, comprising rotating a barrel containing an abrasive at a sufficiently high speed to form a substantially uniform thickness layer of abrasive on the inner peripheral surface of said barrel with the density of the abrasive in the layer varying in the radial direction of the barrel and the density in the layer parallel to the axis of rotation and at any particular radius being substantially uniform, and rotating the pieces within the layer of abrasive around an axis parallel to the axis of rotation of the barrel with the pieces spaced from said parallel axis, while simultaneously rotating said pieces around an axis of the pieces which is also parallel to the axis of rotation of the barrel.

* * * * *